US005176570A

United States Patent [19]

Liedl

[11] Patent Number: 5,176,570

[45] Date of Patent: Jan. 5, 1993

[54] FILTERED COLD AIR BASEBOARD RETURN

[76] Inventor: Loren Liedl, Rte. 4, Box 64C, Amery, Wis. 54001

[21] Appl. No.: 718,253

[22] Filed: Jun. 20, 1991

[51] Int. Cl.[5] ..... F24F 13/08

[52] U.S. Cl. ..... 454/309; 55/481; 55/502; 55/511; 55/DIG. 31; 454/331

[58] Field of Search ..... 55/502, 507, 511, 501, 55/481, DIG. 31; 454/309, 321, 331, 341, 355

[56] References Cited

U.S. PATENT DOCUMENTS 2,575,499 11/1951 Manow ..... 55/481 X
2,754,747 7/1956 Bertling ..... 454/309
2,825,500 3/1958 McLean ..... 55/501 X
3,458,130 7/1969 Juhlin ..... 55/511 X
3,999,969 12/1976 Shuler ..... 55/DIG. 31 X
4,175,936 11/1979 Lough et al. ..... 55/511 X
4,334,899 6/1982 McConnell ..... 55/501 X
4,411,254 10/1983 Field et al. ..... 55/481 X

*Primary Examiner*—Harold Joyce
*Attorney, Agent, or Firm*—James R. Cwayna

[57] ABSTRACT

A filtered cold air return register particularly for base board units which provides for a removable replacement filter section in combination with the normally provided duct covering or end section. The unit provides a filter device for the return air prior to its recycling by the furnace or air conditioning fan.

2 Claims, 2 Drawing Sheets

FILTERED COLD AIR BASEBOARD RETURN

RELATED APPLICATIONS

There are no related applications currently on file in the U.S. Patent Office with which this application should be considered.

FEDERAL SPONSOR

This invention is not made under any federally sponsored research and development arrangement nor any other sponsored research and development arrangement which should be noted.

FIELD OF THE INVENTION

This invention relates generally to forced air heating and air conditioning systems and more particularly to a filtered cold air return for such systems which permit removeability and replacement of the filter device.

SUMMARY OF THE INVENTION

The structure for providing a filter directly into the cold air return systems of forced air units. The unit includes a base board housing which is provided to cap the end of the cold air return and which is normally mounted into the baseboard of such installation to be positioned within the particular room being heated or cooled. This capping device includes a central passage for the communication with the duct. The filter unit includes several forms of the grilled filter arrangement with the filter arranged directly behind the grill for the passage of return air to the furnace or air forcing unit for recycling of the return air. The variations include a grill work structure which is totally removed from the duct end cap, a unit wherein the grill work is pivotally mounted onto the end cap with the filter slid into place behind the grill work and a unit where the grill work is of a relatively larger box shape and provided with a hinged cover for placement of the filter behind the grill work.

The grill work filter unit includes filter retaining devices for proper retention of the filter material in air filtering position and the removeable unit includes sealing means therearound to prevent leakage of air past the grill filter combination.

Each of the forms provides a structure for filtering the air prior to recycling and retreatment of the same and is, in effect, a further particle reduction system to the normal systems which include cold air returns.

BACKGROUND AND OBJECTS OF THE INVENTION

The applicant has searched the commercial availability of filtered cold air return systems and conversely return air systems for air conditioning units which in effect are warm air returns. Applicant has found no such devices and it appears that the primary filtering system in either an air conditioned or heating facility relies on the filtering of the air being delivered rather than air being returned. Obviously the placement of a filter into this return system will provide an ease of access for changing of the filters and will increase the filtering effectiveness, In a search of the prior patented art the applicant has found the following listed U.S. Pat. Nos.: Schroeder, No. 4,713,799, Dec. 15, 1987: Tynan, No. 1,429,811, Sep. 19, 1922; Tropicana, No. 3,046,719, Jul. 31, 1962; Altman, et al., No. 1,726,792, Sep. 3, 1929; Wright No. 1,694,089, Dec. 4, 1928; Anderson, No. 1,886,460 Nov. 8, 1932.

The Anderson and Wright patents are directed to floor type registers and are not directly associated with the register and therefore require total removal of the register for filter access. The Tynan reference is a register attachment and therefore is not integral with the duct system. The Schroeder unit specifically provides a plenum for positioning of a filter behind a hinged grill work and is primarily directed to an overhead air moving system. Applicant's device is particularly directed to a return duct either for retro-fit or new installation and is particularly designed for accommodating baseboard duct mounting. The applicant's design includes ease of access to the filter medium for removal and replacement thereof.

Obviously an advantage of applicant's unit is to increase filtering effect by adding to the normal single furnace or air conditioning filter which only filters upon introduction of air to the used area. By filtering return air the unit accommodating the air movement receives the air in a cleaner condition which is beneficial to the operating unit and probably most commonly is the ease of filter change. Although normally recommended maintenance is to change the primary filter on a regular basis, most homeowners forget to do so and the available placement of returned units in, for example, a home may alert the homeowner to the need for such change.

It is therefore an object of the applicant's invention to provide a filter structure for placement in combination with a return air duct of a forced air heating or cooling unit for filtering of the air as it begins its return cycle.

It is a further object of the applicant's invention to provide a filtered return air structure which provides for ease of access to the filter material for placement and replacement in the air flow line.

It is still a further object of the applicant's invention to provide a baseboard return air filter device for retrofit or new installation including a replaceable filter element therein.

These and other objects and advantages of the applicant's invention will more fully appear from a consideration of the accompanying disclosure and drawings.

DESCRIPTION OF PREFERRED FORMS OF THE INVENTION

Figure 1:
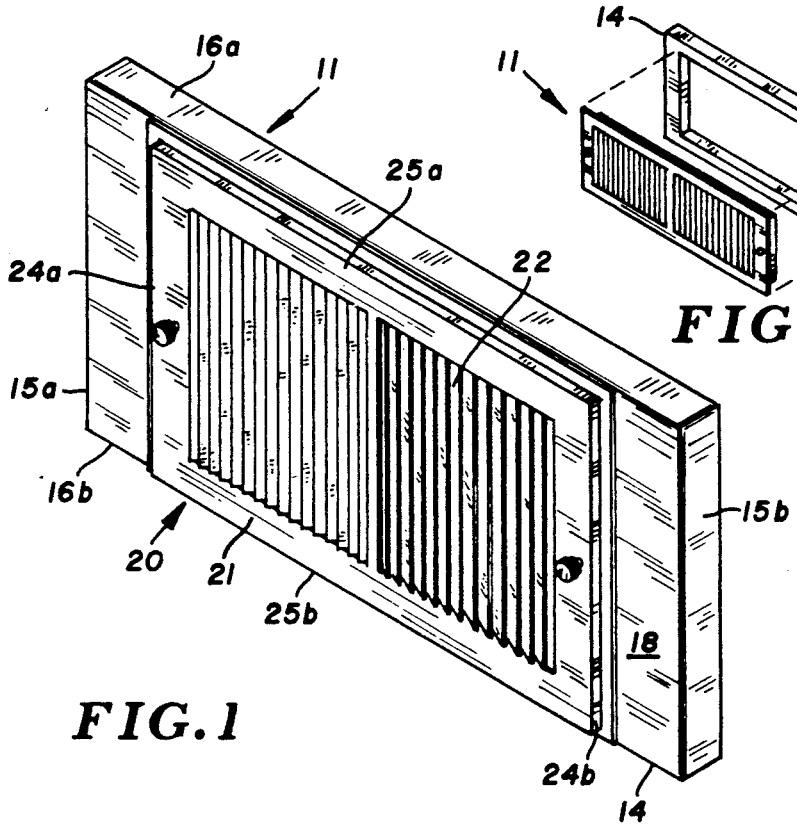
FIG. 1 is a perspective view of an air return duct embodying the filtering grill combination of the applicant's invention wherein the grill filter is completely removeable from the duct end cap.
Figure 3:
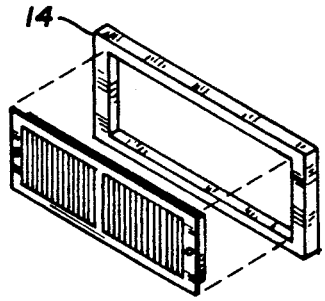
FIG. 3 is a perspective view similar to FIG. 1 illustrating the removeability of the grill filter combination.
Figure 2:
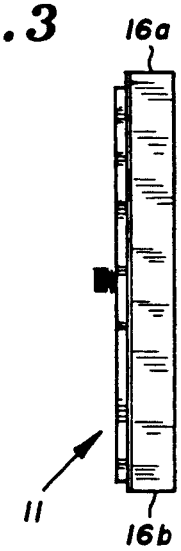
FIG. 2 is a side elevation of the unit as illustrated in FIG. 1.
Figure 4:
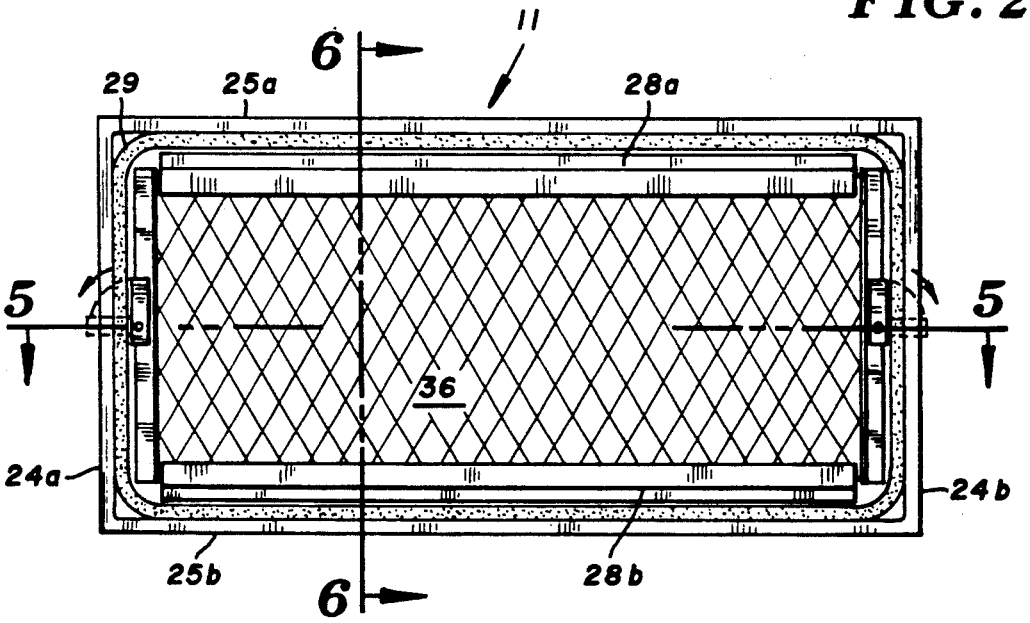
FIG. 4 is a rear elevation of the grill filter element unit which is removeable from the duct cap.
Figure 5:
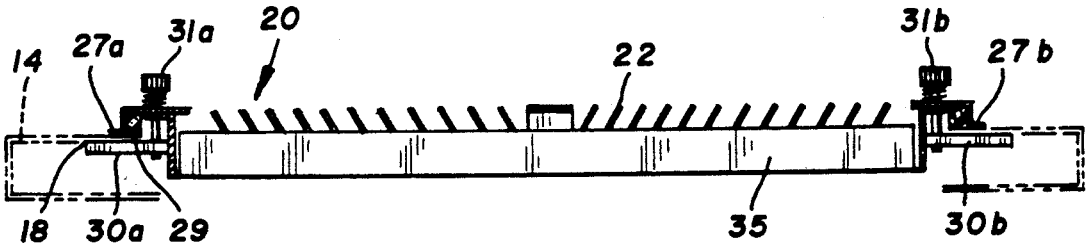
FIG. 5 is a horizontal cross section taken substantially along line 5—5 of FIG. 4.
Figure 6:
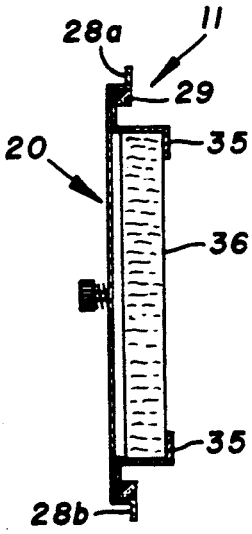
FIG. 6 is a vertical section taken substantially along line 6—6 of FIG. 4.

In accordance with the accompanying drawings applicant has illustrated three structural variations of the filter unit for an air return duct designated respectively 11, 12, 13. In his opinion the form illustrated in FIG. 1 is the most desirable of the three and provides for complete grill filter removal from the end cap of the duct and this form will be used as the primary example. In accordance with the FIGS. 1-6 applicant's unit will include a duct end unit 14 adapted to be positioned on the end of the return duct to normally be mounted within or upon the baseboard dependent upon the particular architectural mode utilized. This end duct member provides a substantially rectangular housing having end walls 15*a*, 15*b* and top and bottom walls 16*a*, 16*b* defining an aperture 17 provided through the front surface 18 thereof. Obviously installation means dependent upon the particular duct structure must be included for installation. The grill work filter element is designated in its entirety 20 and provides a frontal surface 21 having the grill 22 thereon with the front surface again providing end portions 24*a*, 24*b* and upper 25*a*, and lower 25*b* peripherally surrounding sections. As illustrated in FIG. 5 these side elements 24*a*, 24*b*, 25*a*, 25*b* include a shouldered arrangement 27*a*, 27*b*, 28*a*, 28*b* entirely therearound for abutment with the frontal surface 18 of the duct cap and a peripheral seal 29 surrounds the filter element for sealing against the duct cap front surface. As illustrated in FIG. 5 a simple means for connecting and installing the grill filter element includes a rotatable lock flap 30*a*, 30*b* having a control knob 31*a*, 31*b* spring and lock tab which is brought into locking position behind the front face 18 of the duct cap simply by pushing the knob inwardly and rotating the same and thereafter releasing the knob. In the form particularly illustrated in FIG. 4 a set of capturing flanges, each of which is designated 35, are provided to retain the filter 36 in proper position within the member 20. The filter material is extremely flexible to enable bending thereof and placement therebehind the extending ears of this retaining flange. Obviously the flange 35 may be continuous to provide a filter receiving passage. As should be obvious to any acquainted with such units the entire grill filter element is removeable from the duct end cap through rotation of the knobs and associated flaps and the filter material is simply removed from the unit and replaced as required. The entire unit in this form may be of a relatively thin dimension so as not to obtrusively extend into the room.

Figure 7:
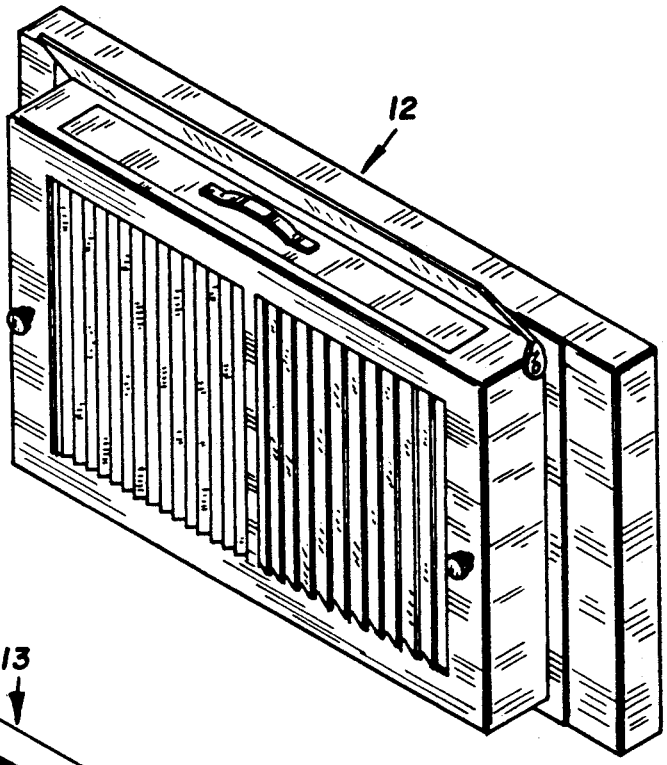
FIG. 7 is a perspective view of a modified form of the invention illustrating a top hinged cover for access to the filter; and, FIG. 8 is a perspective view which illustrates a hinged grill filter unit.
Figure 8:
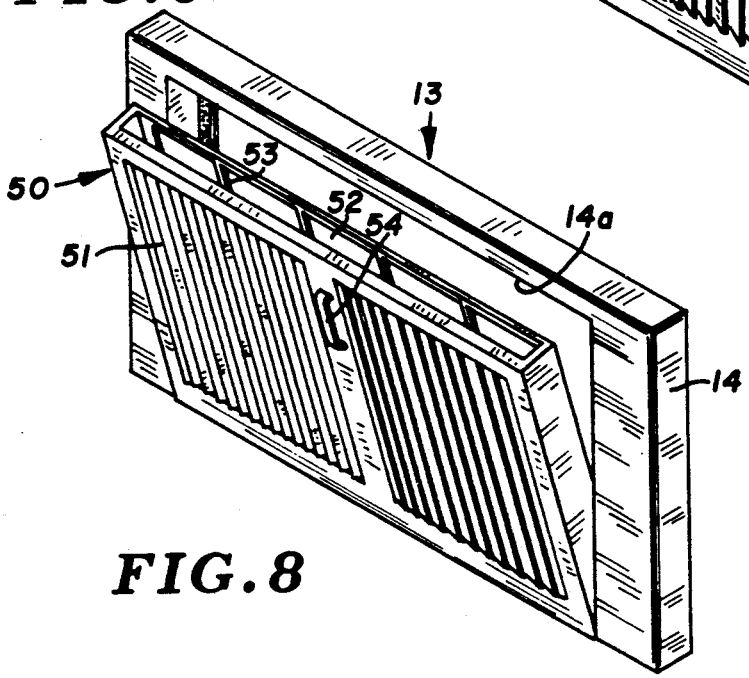

A modified form of the invention is illustrated in FIG. 7 and in this form of the invention the grill filter element unit is simply formed as one piece in combination with the duct end cap structure. Access is provided to the filter which is again arranged behind the grill work section of the unit through a hinged lid on the top surface of the grill filter combination. For this particular form of the invention applicant has considered a self contained filter which normally consists of a filter surrounded by a cardboard housing. This unit could then be provided with a handle for ease of replacement of the filter and in this form the filter element would be made available in such a particular structure.

The third form of the invention is designated 13 and in this case the duct end cap is provided with a recess to receive a hinged door which door provides the veined grill work front surface and a pocket for receipt of drop in filter material. The rear surface of this pocket would provide sufficient support for the filter material with minimal blockage of air flow and would basically be a minimal set of vertical arms. Obviously some type of handle means would be provided for ease of opening the grill filter from the duct end cap.

Each of the forms of the invention provide a simple means for including a filter element into a grill area of a return duct with each of them having different advantages but each of them accomplishing the desired effect which is to increase filtering and the elimination of airborn particles being drawn into the operative air moving devices of the particular installation.

What I claim is:

1. A filtered cold air baseboard return for use with forced air heating systems which systems includes ductwork for forced and return air transmittal, such return including:

a) a duct end covering arranged and constructed for placement on and attachment to the end of a cold air return duct;

b) said duct end covering having an air flow passage therethrough for receiving air from an area and returning it to the forced air system;

c) the front surface of said duct end covering providing a substantially flat surface;

d) means for positioning a filter medium in filtering relation to said air flow passage and against said frontal surface of said duct end;

e) said filter positioning means including a housing of a size to cover said air flow passage of said duct end;

f) said housing including means for removeably positioning a filtering medium therein;

g) said housing including means for positioning an air seal in position surrounding said filtering medium and in position to seal against said frontal surface of said duct end; and h) means for removably attaching said filter positioning housing to said duct end.

2. The filtered cold air baseboard return as set forth in claim 1, and said means for removably attaching said filter positioning housing including rotatable locking flaps on said filter positioning housing and flap receiving areas defined on said duct end covering.

* * * * *